US008894389B2

(12) United States Patent
Meza et al.

(10) Patent No.: US 8,894,389 B2
(45) **Date of Patent: *Nov. 25, 2014**

(54) RECHARGEABLE BATTERY POWERED UTILITY PUMP WITH SERIES CENTRIFUGAL PUMP CONFIGURATION

(75) Inventors: Humberto V. Meza, Tustin, CA (US); Randall H. Moormann, Georgetown, MA (US); Mark F. Ingersoll, North Java, NY (US); Jeffrey B. Schopperle, Wakefield, MA (US); Joel A. Kenney, Beverly, MA (US)

(73) Assignee: Flow Control LLC., Gloucester, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/300,174

(22) Filed: Nov. 18, 2011

(65) Prior Publication Data

US 2013/0052060 A1 Feb. 28, 2013

Related U.S. Application Data

(63) Continuation of application No. 13/222,303, filed on Aug. 31, 2011.

(51) Int. Cl.

| | |
|---|---|
| ***F04B 17/03*** | (2006.01) |
| ***H01M 2/10*** | (2006.01) |
| ***F04B 17/06*** | (2006.01) |

(52) U.S. Cl.

CPC ..... *F04B 17/06* (2013.01); *F04B 17/03* (2013.01)

USPC ..... 417/411; 429/97; 429/100

(58) Field of Classification Search

CPC .. F04D 25/0673; H01M 2/1011; H01M 2/105

USPC ..... 417/234, 411, 423.3, 423.14; 429/97, 429/100, 123

See application file for complete search history.

(56) References Cited

U.S. PATENT DOCUMENTS 1,676,945 A * 7/1928 Ellis ..... 429/72
2,503,287 A 4/1950 Moore (Continued)

FOREIGN PATENT DOCUMENTS

CA 2538068 8/2007
GB 2400759 10/2004

(Continued)

OTHER PUBLICATIONS

English language abstract for JP2006269292 (1 page).

(Continued)

*Primary Examiner* — Devon C. Kramer
*Assistant Examiner* — Alexander Comley

(57) ABSTRACT

A utility pump is provided featuring a housing and battery configuration, where the housing is configured with a series configuration of integral pumps, and also configured with a battery receiving portion having electrical terminals for receiving power for providing to the series configuration of the integral pumps, and where the battery has a protruding portion with corresponding electrical terminals configured to contact the electrical terminals to provide power to the series configuration of the integral pumps when the protruding portion of the battery is inserted into the battery receiving portion of the housing and rotated in one direction to an "ON" position, and also configured not to contact the electrical terminals when the battery is not rotated to the "ON" position.

14 Claims, 6 Drawing Sheets

(56) References Cited

U.S. PATENT DOCUMENTS

| | | | | | |
|---|---|---|---|---|---|
| 3,780,245 | A | | 12/1973 | Beddow | |
| 4,230,777 | A | * | 10/1980 | Gatto | 429/97 |
| 5,094,591 | A | * | 3/1992 | Whitley et al. | 417/234 |
| 5,388,748 | A | | 2/1995 | Davignon et al. | |
| 5,445,900 | A | * | 8/1995 | Miller et al. | 429/1 |
| 5,476,729 | A | * | 12/1995 | Miller et al. | 429/1 |
| 5,557,810 | A | | 9/1996 | Antos et al. | |
| 5,596,314 | A | * | 1/1997 | Goldstein | 340/632 |
| 5,662,505 | A | | 9/1997 | Spriggs | |
| 5,734,254 | A | | 3/1998 | Stephens | |
| 5,833,437 | A | * | 11/1998 | Kurth et al. | 417/36 |
| 5,996,977 | A | | 12/1999 | Burgess | |
| 6,085,364 | A | | 7/2000 | Baierlein | |
| 6,139,359 | A | * | 10/2000 | Fuhreck et al. | 439/500 |
| D439,561 | S | * | 3/2001 | Lee et al. | D13/103 |
| 6,220,720 | B1 | * | 4/2001 | Stephens | 362/205 |
| 6,551,123 | B1 | | 4/2003 | Schaeffeler et al. | |
| 6,582,259 | B1 | | 6/2003 | Mansson et al. | |
| 6,712,654 | B1 | | 3/2004 | Putaansuu | |
| 6,793,469 | B2 | * | 9/2004 | Chung | 417/411 |
| 6,811,099 | B2 | * | 11/2004 | Krestine et al. | 239/524 |
| 6,869,299 | B2 | | 3/2005 | Tanaka et al. | |
| D515,027 | S | * | 2/2006 | Groh et al. | D13/103 |
| 6,994,576 | B2 | | 2/2006 | Tanaka et al. | |
| D528,502 | S | * | 9/2006 | Fleetwood | D13/103 |
| D531,117 | S | * | 10/2006 | Schrick et al. | D13/103 |
| 7,709,136 | B2 | * | 5/2010 | Touchton et al. | 429/96 |
| RE42,559 | E | * | 7/2011 | Wang | 417/411 |
| D649,163 | S | * | 11/2011 | Moormann et al. | D15/7 |
| D667,466 | S | * | 9/2012 | Barmore et al. | D15/7 |
| 8,319,357 | B2 | * | 11/2012 | Usselman et al. | 290/1 A |
| 2002/0119050 | A1 | * | 8/2002 | Nakamura et al. | 417/2 |
| 2002/0176782 | A1 | * | 11/2002 | Batchelder et al. | 417/36 |
| 2004/0058632 | A1 | * | 3/2004 | Boyer | 451/344 |
| 2004/0189245 | A1 | | 9/2004 | Teraoka et al. | |
| 2005/0241926 | A1 | * | 11/2005 | Groh et al. | 200/50.2 |
| 2005/0244287 | A1 | | 11/2005 | Dobrynski | |
| 2006/0222506 | A1 | * | 10/2006 | Rival | 417/2 |
| 2006/0267556 | A1 | * | 11/2006 | Uehlein-Proctor et al. | 320/132 |
| 2006/0269426 | A1 | | 11/2006 | Llewellyn | |
| 2007/0003825 | A1 | * | 1/2007 | Touchton et al. | 429/97 |
| 2007/0048157 | A1 | * | 3/2007 | Collins et al. | 417/423.3 |
| 2007/0169980 | A1 | | 7/2007 | Weeramantry et al. | |
| 2008/0044295 | A1 | | 2/2008 | Goliat | |
| 2008/0226476 | A1 | * | 9/2008 | Lau | 417/411 |
| 2008/0250857 | A1 | * | 10/2008 | Burdi et al. | 73/304 C |
| 2008/0265844 | A1 | | 10/2008 | Smith et al. | |
| 2008/0286124 | A1 | * | 11/2008 | Sen et al. | 417/234 |
| 2009/0050042 | A1 | | 2/2009 | Waldecker | |
| 2009/0102420 | A1 | * | 4/2009 | Uehlein-Proctor et al. | 320/114 |
| 2010/0209752 | A1 | * | 8/2010 | Lerner et al. | 429/97 |
| 2011/0158834 | A1 | * | 6/2011 | Pan | 417/423.14 |

FOREIGN PATENT DOCUMENTS

| | | |
|---|---|---|
| GB | 2406004 | 3/2005 |
| JP | 2006269292 | 10/2006 |
| WO | 2005099043 | 10/2005 |
| WO | 2008036418 | 3/2008 |
| WO | 2008057386 | 5/2008 |

OTHER PUBLICATIONS

English language abstract for TW235516, also published as and cited herein as US6869299 (1 page).

* cited by examiner

RECHARGEABLE BATTERY POWERED UTILITY PUMP WITH SERIES CENTRIFUGAL PUMP CONFIGURATION

CROSS REFERENCE TO RELATED APPLICATIONS

This application is a continuation-in-part application of patent application Ser. No. 13/222,303, filed 31 Aug. 2011, entitled Portable Battery Operated Bilge Pump, which is hereby incorporated by reference in its entirety.

BACKGROUND OF THE INVENTION

The present invention relates to a pump; and more particularly a rechargeable portable utility pump.

SUMMARY OF THE INVENTION

The present invention provides a utility pump featuring a new and unique combination of a housing and a battery. According to some embodiments of the present invention, the housing may be configured with a series configuration of integral pumps, and also configured with a battery receiving portion having electrical terminals for receiving power for providing to the series configuration of the integral pumps; and the battery may include a protruding portion with corresponding electrical terminals configured to contact the electrical terminals of the battery receiving portion to provide power to the series configuration of the integral pumps when the protruding portion of the battery is inserted into the battery receiving portion of the housing and rotated in one direction to an "ON" position, and also configured so as not to contact the electrical terminals when the battery is not rotated to the "ON" position.

According to some embodiments of the present invention, the utility pump may also include one or more of the following features:

The series configuration of the integral pumps may include a first centrifugal pump and a second centrifugal pump.

A suction side of the first centrifugal pump may be configured to receive a fluid through a lower strainer unit, and/or a discharge of the first centrifugal pump may be configured to be directly integrated into a corresponding suction side of the second centrifugal pump so that the fluid is then discharged out the second centrifugal pump through a fitting.

The utility pump may include a rechargeable battery pack and printed circuit board (PCB) controls that are housed inside a thermoplastic assembly or housing.

The protruding portion may also include a cylindrical wall with an O-ring configured to frictionally engage and make sealing contact with an internal wall of the battery receiving portion to prevent the fluid from contacting the electrical terminals and the corresponding electrical terminals when the battery is inserted into the battery receiving portion, so that the utility pump may be operated when either partially and totally submersed in the fluid.

The battery receiving portion may include an internal wall configured with at least one axial channel therein; and the protruding portion may include an external wall having at least one protruding portion configured to engage the at least one axial channel for guiding and orienting the battery when inserted into the battery receiving portion into a first rotational position.

The internal wall of the battery receiving portion may also be configured with at least one partial circumferential channel; and the at least one protruding portion may also be configured to engage the partial circumferential channel for rotating the battery from the first rotational position when the protruding portion of the battery is inserted into the battery receiving portion of the housing into either a second rotational position, including the "ON" position where the series configuration of integral pumps is turned "ON", or to a third rotational position, including the "OFF" position where the series configuration of the integral pumps is turned "OFF."

The at least one axial channel may also include two axial channels disposed on opposite sides of the battery receiving portion, and the at least partial circumferential channel may also include two partial circumferential channels; and the external wall of the protruding portion may include two protruding portions configured to engage respectively the two axial channels for guiding and orienting the battery when inserted into the battery receiving portion, and also to engage the two partial circumferential channel for positioning the battery in either the second rotational position ("ON") or the third rotational position ("OFF").

The two axial channels may be configured and dimensioned with different sizes, and the two protruding portions may be configured and dimensioned with corresponding different sizes, so that the battery can only be inserted into the battery receiving portion with one orientation.

The at least one partial circumferential channel may include a flexible locking device having a first face and a second face and being configured on a flexible hinge portion. The first face may be configured on an angle so as to respond to the at least one protruding portion and flex the flexible locking device downwardly into an opening or slot and below the channel surface so as to allow the at least one protruding portion to slide or pass by when the battery is rotated in the one direction in the battery receiving portion. The flexible locking device may be configured to flex back upwardly above the channel surface once the at least one protruding portion slides or passes by the first face. The second face may be configured to extend into the partial circumferential channel above the channel surface so as to prevent the at least one protruding portion from passing or sliding by when the battery is rotated in an opposite direction in the battery receiving portion so as to lock the battery in the battery receiving portion so it cannot be removed.

The housing may also include a switch configured to respond to a switching actuation and move the flexible locking device downwardly into the opening or slot and below the channel surface to allow the at least one protruding portion to pass by when the battery is rotated in the opposite direction in the battery receiving portion, so that the battery may be moved to the first rotational position and removed from the battery receiving portion.

The battery receiving portion may also be configured with a flat wall having the electrical terminals arranged thereon; and the protruding portion may also be configured with a corresponding flat wall having the corresponding electrical terminals arranged thereon for contacting the electrical terminals when the battery is inserted into the battery receiving portion and rotated.

The housing may also have a detachable two-part construction, including a lower part configured with openings to receive fluid to be pumped, and an upper part configured with an outlet port for providing the fluid being pumped.

The battery may be a rechargeable battery.

The battery may also include a cover position having an arrow-shaped member configured to provide a visual indication of the orientation of the battery.

BRIEF DESCRIPTION OF THE DRAWING

The drawing, which is not necessarily drawn to scale, includes the following Figures:

FIG. 9*a* is an isometric view of the utility pump, and FIG. 9*b* is a cross-sectional view of the utility pump shown in FIG. 9*a*.

DETAILED DESCRIPTION OF THE INVENTION

FIGS. 1-8 show a pump generally indicated as 10 that features a new and unique combination, arrangement or configuration of a housing 12 and a battery 14, including a rechargeable battery, which is disclosed and claimed in patent application Ser. No. 13/222,303, filed 31 August 2011, consistent with that set forth below. For the convenience of the reader, it is noted that the subject matter shown in FIGS. 9*a* and 9*b* and the description thereof set forth below form the basis of the additional subject matter of the instant continuation-in-part patent application as set forth herein.

Figure 3:
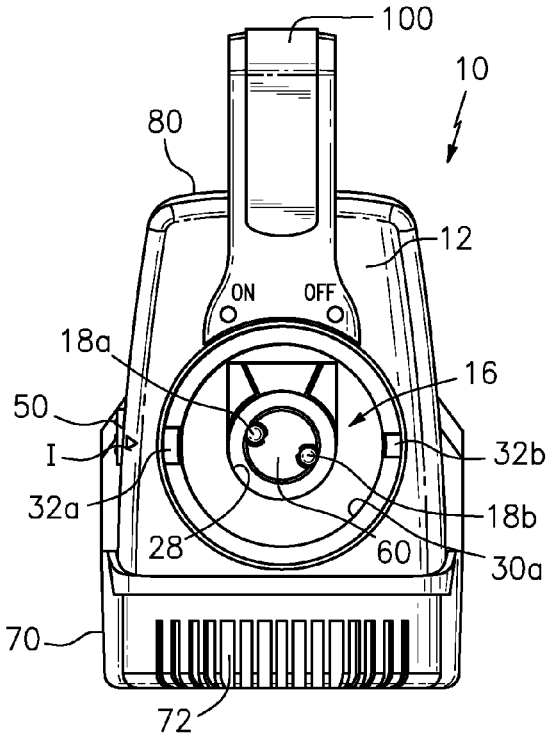
FIG. 3 is a front view of the portable bilge pump shown in FIG. 1 without the battery inserted, according to some embodiments of the present invention.
Figure 5:
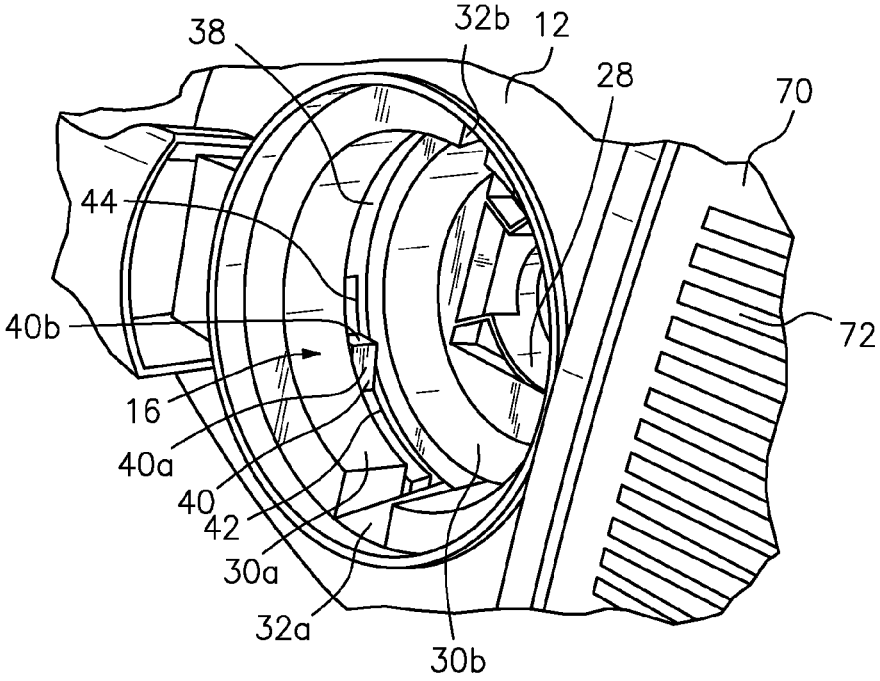
FIG. 5 is a partial perspective view of the portable bilge pump shown in FIG. 3 according to some embodiments of the present invention.

As shown by way of example in FIGS. 3 and 5, the housing 12 may be configured with a battery receiving portion generally indicated as 16 having electrical terminals 18*a*, 18*b* for receiving power to the pump 10. The battery receiving portion 16 is configured or formed as a cavity in part of the housing 12 that is dimensioned to receive some portion of the battery 14, consistent with that described herein.

Figure 2:
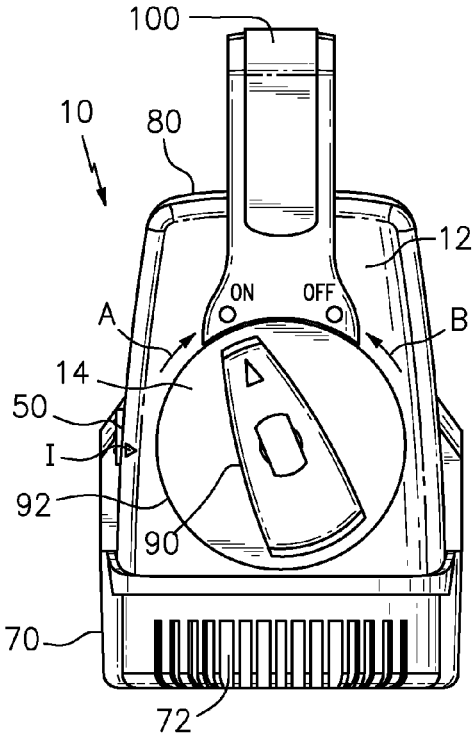
FIG. 2 is a front view of the portable bilge pump shown in FIG. 1 with the battery inserted, according to some embodiments of the present invention.
Figure 6:
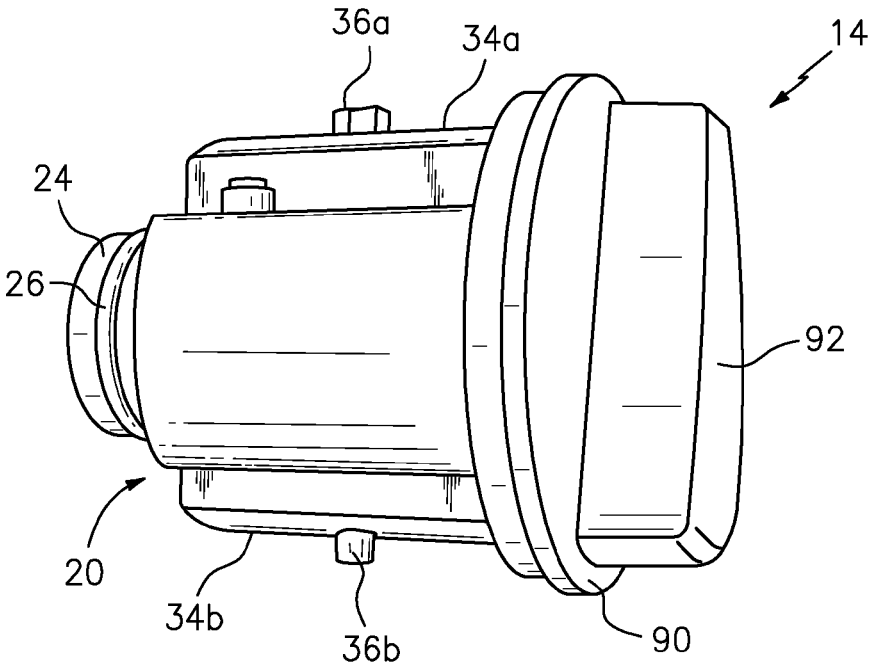
FIG. 6 is a side view of a battery that forms part of the portable bilge pump shown in FIG. 1 according to some embodiments of the present invention.
Figure 7:
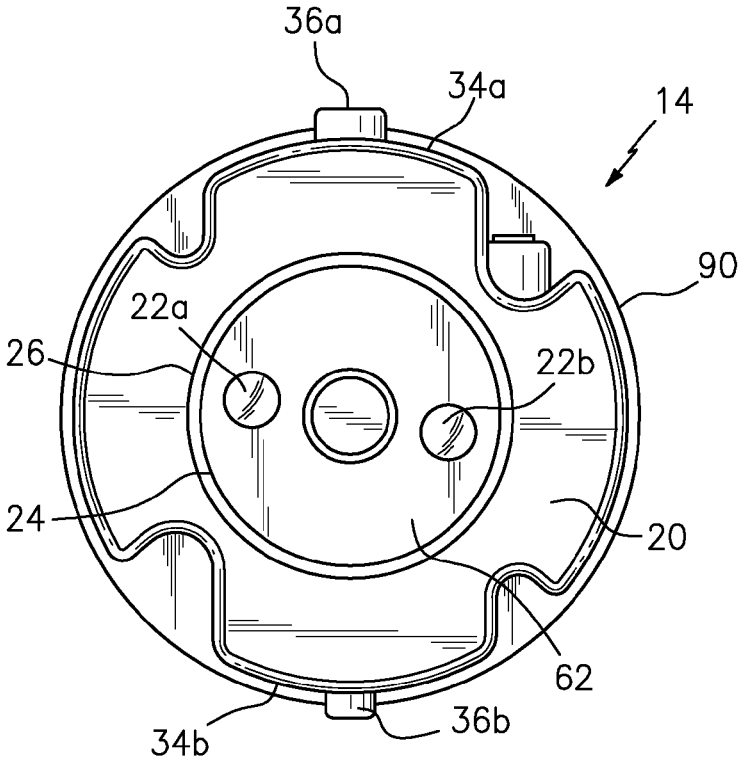
FIG. 7 is a back view of the battery shown in FIG. 6 according to some embodiments of the present invention.
Figure 8:
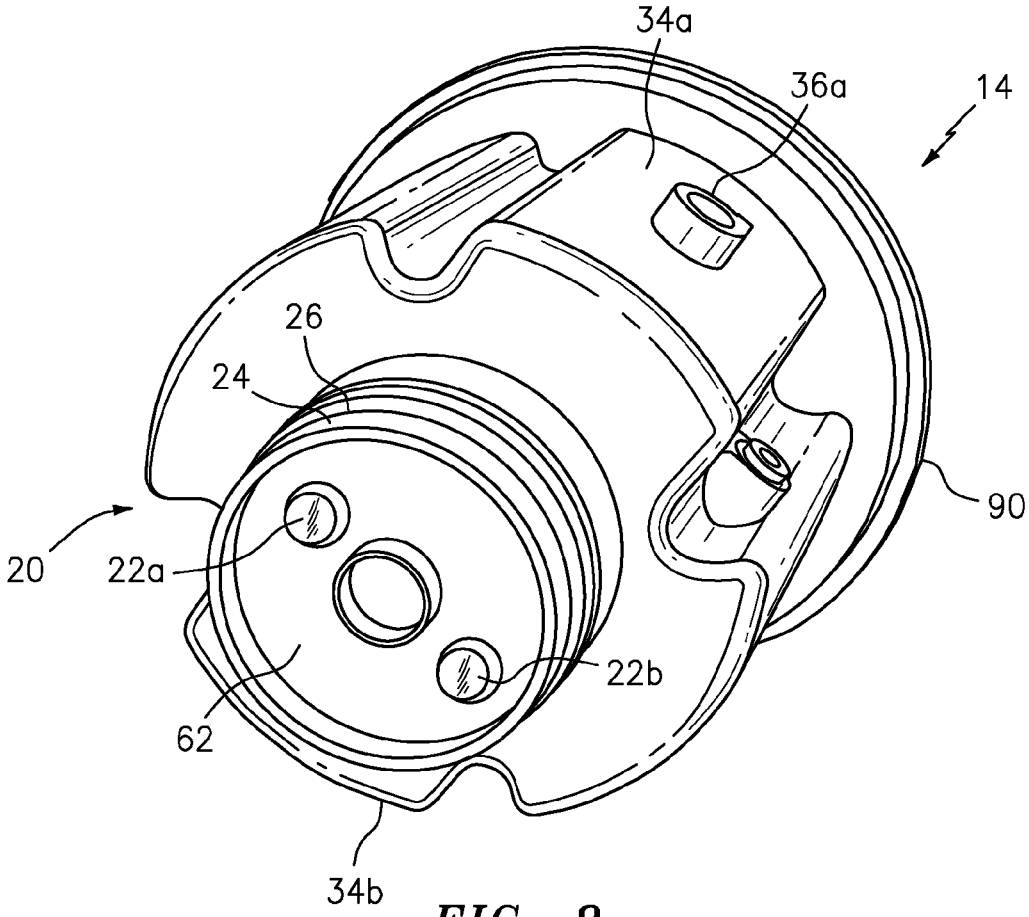
FIG. 8 is a perspective view of the battery shown in FIG. 6 according to some embodiments of the present invention.

As shown by way of example in FIGS. 6-8, the battery 14 may include a protruding portion 20 with corresponding electrical terminals 22*a*, 22*b* configured to contact the electrical terminals 18*a*, 18*b* of the battery receiving portion 16 to provide power to the pump 10 when the protruding portion 20 of the battery 14 is inserted into the battery receiving portion 16 of the housing 12 as shown in FIG. 2 and rotated in one direction indicated by arrow A (FIG. 2) to an "ON" position, and also configured so as not to contact the electrical terminals when the battery 14 is not rotated to the "ON" position. The battery 14 is not rotated to the "ON" position when it is any other rotational position other than in the "ON" position, e.g., including when it is in a battery insert position generally indicated by reference label I in FIGS. 2-3, and also including when it is in the "OFF" position.

As shown by way of example in FIG. 6, the protruding portion 20 may also include a cylindrical wall 24 with an O-ring 26 configured to frictionally engage and make sealing contact with one cylindrical internal wall 28 of the battery receiving portion 16 as shown in FIGS. 3 and 5 to prevent the fluid from contacting the electrical terminals 18*a*, 18*b* (FIG. 3) and the corresponding electrical terminals 22*a*, 22*b* (FIG. 7) when the battery 14 is inserted into the battery receiving portion 16 as shown in FIG. 2, so that the pump 10 may be operated when either partially and totally submersed in the fluid. The configuration of the cylindrical wall 24 and O-ring 26 includes the cylindrical wall 24 having an annular channel or groove for receiving and retaining the O-ring 26 therein, as well as embodiments in which the O-ring 26 is arranged on the cylindrical wall 24 without using an annular channel or groove.

As shown by way of example in FIGS. 3 and 5, the battery receiving portion 16 may include another internal wall 30*a* configured with at least one axial channel 32*a*, 32*b* formed therein. As shown in FIGS. 6-8, the protruding portion 20 may include at least one external wall 34*a*, 34*b* with at least one protruding portion 36*a*, 36*b* configured to engage the at least one axial channel 32*a*, 32*b* for guiding and orienting the battery 14 when inserted into the battery receiving portion 16 as shown in FIG. 2 into a first rotational position as indicated by reference label I in FIGS. 2-3.

As shown by way of example in FIG. 5, the internal wall 30*a* of the battery receiving portion 16 may also be configured with at least one partial circumferential channel 38 that is formed between the internal wall 30*a* and a corresponding internal wall 30*b*. The at least one protruding portion 36*a* shown in FIGS. 6-8 may also be configured to engage the partial circumferential channel 38 shown in FIG. 5 for rotating the battery 14 from the first rotation position I (FIGS. 2-3) when the protruding portion 20 of the battery 14 is inserted into the battery receiving portion 16 of the housing 12 as shown in FIG. 2 into either a second rotational position, such as the "ON" position where the pump is turned "ON", or to a third rotational position, such as the "OFF" position where the pump is turned "OFF", as shown in FIG. 2.

As shown by way of example in FIGS. 3 and 5, the two axial channels 32*a*, 32*b* are configured, disposed, arranged or formed on opposite sides of the battery receiving portion 16. In embodiments having two protruding portions 36*a*, 36*b* (FIGS. 6-8), the at least partial circumferential channel 38 may include a second partial circumferential channel for receiving the corresponding protruding portion 36*b*. The second partial circumferential channel is not shown in FIG. 5, but is understood to be configured substantially similar to the partial circumferential channel 38 and dimensioned to receive the protruding portion 36*b*. Embodiments are envisioned using one protruding portion, e.g., element 36*a*, so that one corresponding circumferential channel, e.g., element 38, may be formed in the battery receiving portion 16 for receiving the same. In operation, when inserted into the battery receiving portion 16 the two corresponding protruding portions 36*a*, 36*b* are configured to engage respectively the two axial channels 32*a*, 32*b* for guiding and orienting the battery 14 in the battery receiving portion 16; and the two corresponding protruding portions 36*a*, 36*b* are also configured to engage the two partial circumferential channels 38 for rotating and positioning the battery 14 in some other rotational position, including either the second rotational position (i.e. the "ON" position) or the third rotational position (i.e. the "OFF" position), as shown in FIGS. 2-3.

As shown by way of example in FIGS. 3 and 5 and FIGS. 6-8, the two axial channels 32*a*, 32*b* may be configured and dimensioned with different sizes, and the two protruding portions 36*a*, 36*b* may also be configured and dimensioned with corresponding different sizes, so that the battery 14 can only be inserted into the battery receiving portion 16 with one orientation, i.e. the larger protruding portion 36*a* is received by the larger dimensioned axial channel 32*a* and the smaller protruding portion 36*b* is received by the smaller dimensioned axial channel 32*b*, as shown in FIGS. 3 and 5-7. The scope of the invention is not intended to be limited to any particular dimension or size of the axial channels 32*a*, 32*b* or protruding portions 36*a*, 36*b* in relation to one another or each other.

As shown by way of example in FIG. 5, the at least one partial circumferential channel 38 may also include a flexible locking device 40 having a first face 40*a* and a second face 40*b* and being configured on a flexible hinge portion 42. The first face 40*a* is configured on an angle so as to respond to the at least one protruding portion 36*a* and flex the flexible locking device 40 downwardly into an opening or slot 44 and below the channel surface so as to allow the at least one protruding portion 36*a* to slide or pass by when the battery 14 is rotated in the one direction A (see FIG. 2) in the battery receiving portion 16. Once the at least one protruding portion 36*a* has slid and passed by the first face 40*a* when the battery 14 is rotated in the one direction A (FIG. 2), the flexible locking device 40 is configured to flex back upwardly above the channel surface. In this position, the second face 40*b* is configured to extend into the partial circumferential channel 38 so as to prevent the at least one protruding portion 36*a* from passing or sliding by when the battery 14 is rotated in an opposite direction B (see FIG. 2) in the battery receiving portion 16 so as to lock the battery 14 in the battery receiving portion 16 so it cannot be removed.

Figure 1:
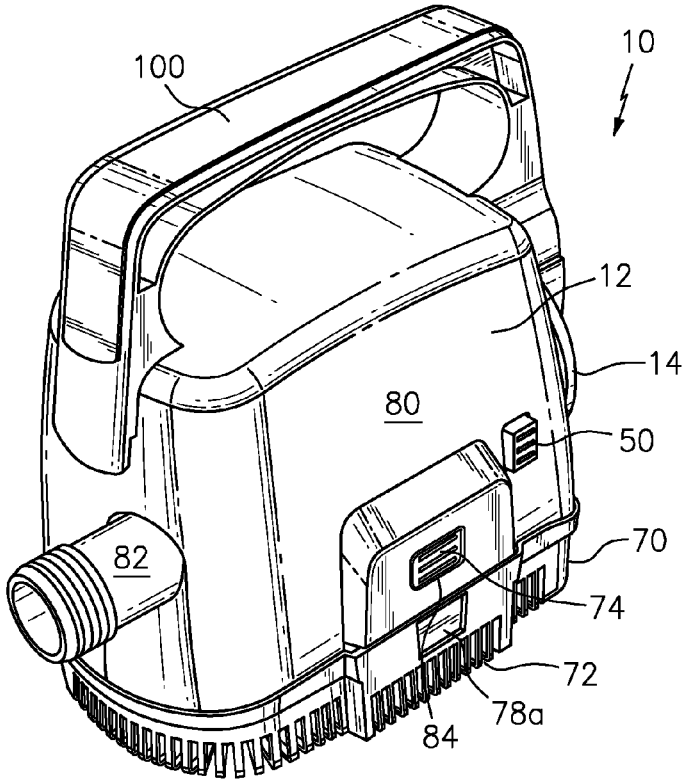
FIG. 1 is a top perspective view of a portable bilge pump according to some embodiments of the present invention.

As shown by way of example in FIGS. 1-3, the housing 12 may also include a switch or button 50 configured to respond to a switching actuation, e.g., by a user pressing the button, and move the flexible locking device 40 downwardly so the second face 40*b* is below the channel surface to allow the at least one protruding portion 36*a* to pass by when the battery 14 is rotated in the opposite direction B (FIG. 2) in the battery receiving portion 16, so that the battery 14 may be moved to the first rotational position I (FIG. 2) and removed from the battery receiving portion 16. The scope of the invention is not intended to be limited to the type or kind of coupling between the switch 50 and the flexible locking device 40, and a person skilled in the art would be able to implement such a coupling without undue experimentation. By way of example, such a coupling may include an embodiment in which the switch or button 50 is pressed inwardly by a user so the flexible locking device 40 moves downwardly below the channel surface and stays in place until the switch or button 50 is pressed a second time to release the flexible locking device 40 and moves upwardly above the channel surface. Alternatively, such a coupling may include an embodiment in which the switch or button 50 may be pressed inwardly by the user and held by the user so the flexible locking device 40 moves downwardly below the channel surface and stays in place until the switch or button 50 is released by the user such that the flexible locking device 40 moves upwardly back above the channel surface.

As shown by way of example in FIG. 3, the battery receiving portion 16 may also be configured with a flat wall 60 having the electrical terminals 18*a*, 18*b* arranged thereon. As shown in FIGS. 6-8, the protruding portion 20 may also be configured with a corresponding flat wall 62 having the corresponding electrical terminals 22*a*, 22*b* arranged thereon for contacting the electrical terminals 18*a*, 18*b* when the battery 14 is inserted into the battery receiving portion 16 and rotated. Embodiment are also envisioned in which the electrical terminals 18*a*, 18*b* (FIG. 3) may be arranged on the cylindrical internal wall 28 and the corresponding electrical terminals 22*a*, 22*b* (FIGS. 6-8) may be arranged on the cylindrical wall 24 so as to make electrical contact when the protruding portion 20 is inserted into the battery receiving portion 16 of the housing 12 and suitably rotated to the "ON" position. Embodiment are also envisioned where one electrical terminal may be arranged on a flat wall and the other electrical terminal may be arranged on a cylindrical wall, and where one corresponding electrical terminal may be arranged on a corresponding flat wall and the other corresponding electrical terminal may be arranged on a corresponding cylindrical wall, so as to make electrical contact when the protruding portion 20 is inserted into the battery receiving portion 16 of the housing 12 and suitably rotated to the "ON" position.

Figure 4:
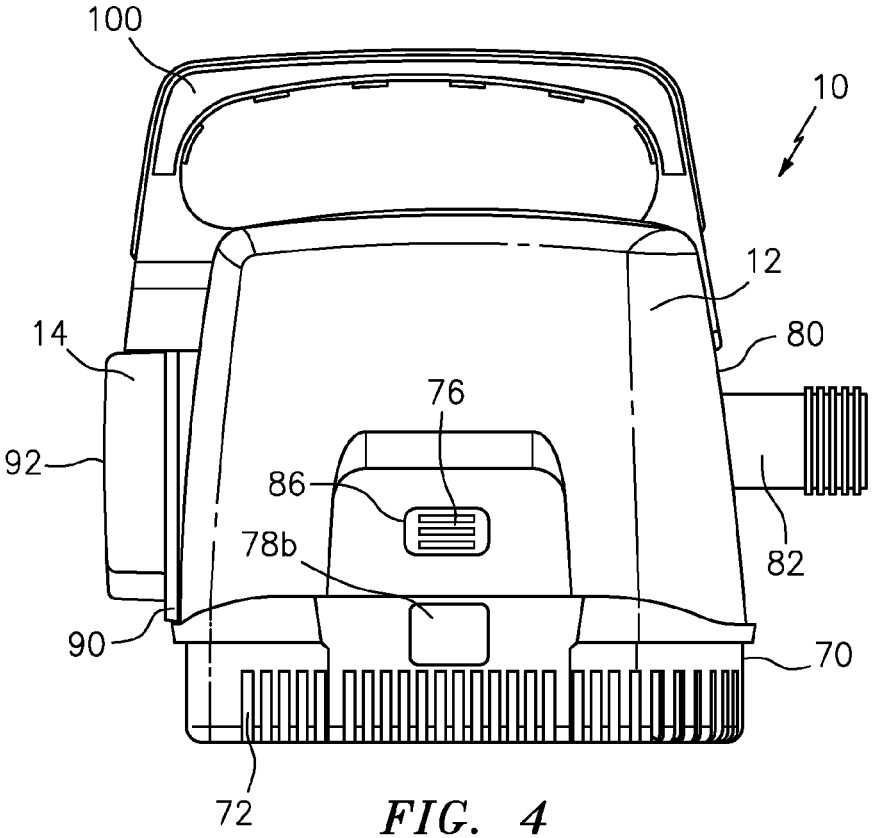
FIG. 4 is a side view of the portable bilge pump shown in FIG. 1 according to some embodiments of the present invention.

As shown by way of example in FIGS. 2, 4 and 6, the battery 14 may be configured with a cover portion 90 having an arrow-shaped member 92 configured to provide a visual indication of the orientation of the battery 14. For example, when the battery 14 inserted in the battery receiving portion 16, the arrow-shaped member 92 would be pointed to the reference label I in FIG. 2; when the battery 14 is rotated to the "ON" position in the battery receiving portion 16, the arrow-shaped member 92 would be pointed to the reference label "ON" in FIG. 2; and when the battery 14 is rotated to the "OFF" position in the battery receiving portion 16, the arrow-shaped member 92 would be pointed to the reference label "OFF" in FIG. 2.

As shown by way of example in FIGS. 1-5, the housing 12 may be configured as a detachable two-part construction, including a lower part 70 configured with openings 72 to receive fluid to be pumped, and an upper part 80 configured with an outlet port 82 for providing the fluid being pumped. The lower part 70 has tabs 74 (FIG. 1) and 76 (FIG. 4) that are configured to be received in corresponding openings 84 (FIG. 1) and 86 (FIG. 4) of the upper part 80 and pressed, e.g., by fingers of a user, to detach and release the lower part 70 from the upper part 80. The lower part 70 is also configured with recesses 78*a* (FIG. 1) and 78*b* (FIG. 4) to be engaged, e.g., with the other fingers of the user, when detaching the lower part 70 and the upper part 80. Embodiments are also envisioned in which the pump 10 is assembled and the two parts 70, 80 of the housing 12 are sealed together, e.g., using an ultrasonic sealing or welding. The housing 12 may also be configured with a handle 100 as shown in FIGS. 1-4 for portably carrying the pump 10.

It is understood that the pump 10 is configured to contain some kind of pumping device (not shown) inside the housing 10. Pumping devices are known in the art and the scope of the invention is not intended to be limited to any particular type, kind or implementation thereof either now known or later developed in the future, including by way of example, a diaphragm pump. The pumping device itself does not form part of the underlying invention, and thus is not shown or described in detail. Moreover, consistent with that disclosed herein, a person skilled in the art would be able to implement such a pumping device, e.g., a diaphragm pump, into the housing 12 without undue experimentation within the spirit of the underlying invention in order to make the pump 10 receive the fluid in the openings 72 (FIGS. 1-4) and provide the fluid from the port 82 (FIGS. 1 and 4).

Figure 9A:
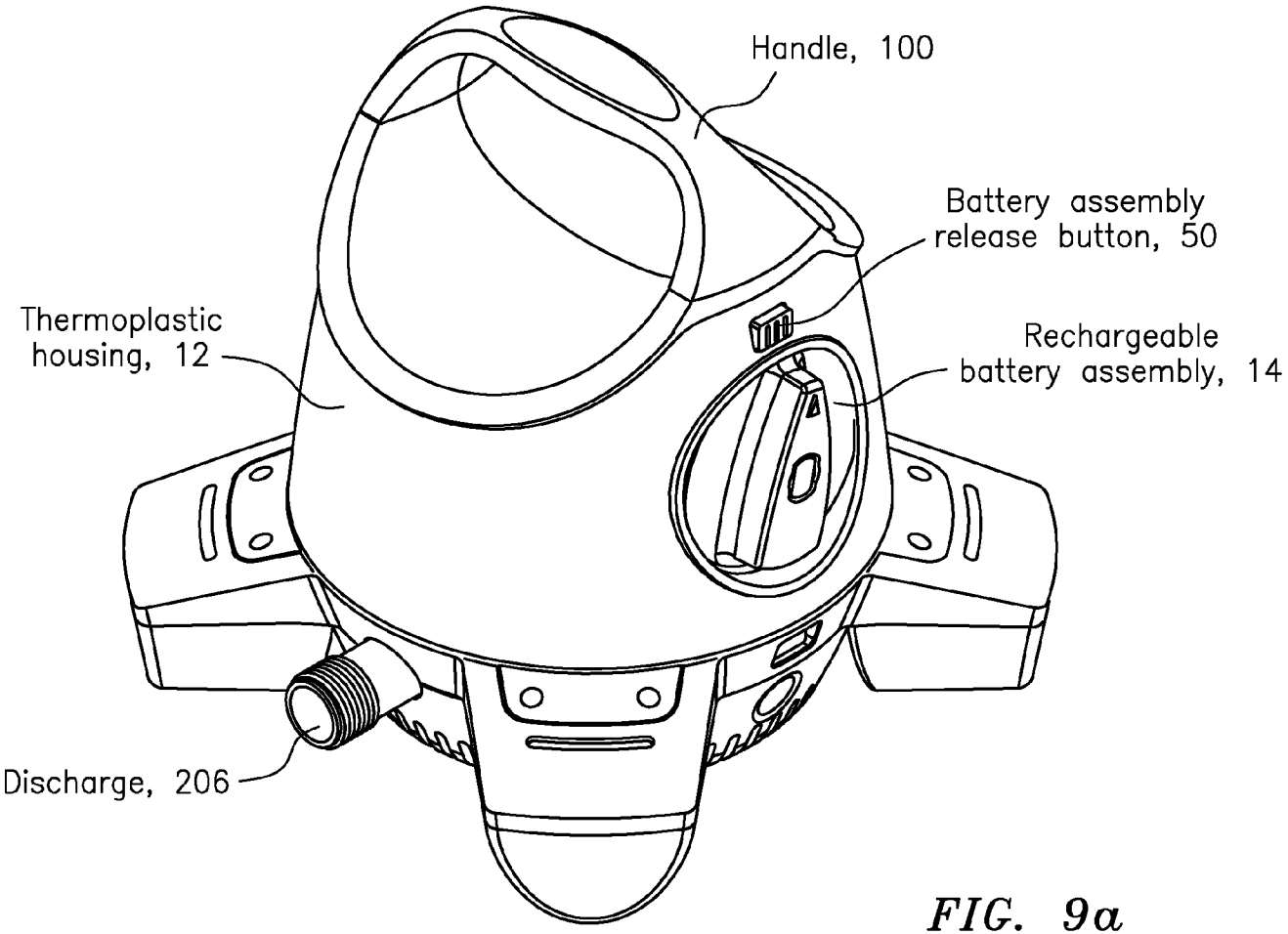
FIGS. 9*a*, 9*b* show a utility pump according to some embodiments of the present invention, where
Figure 9B:
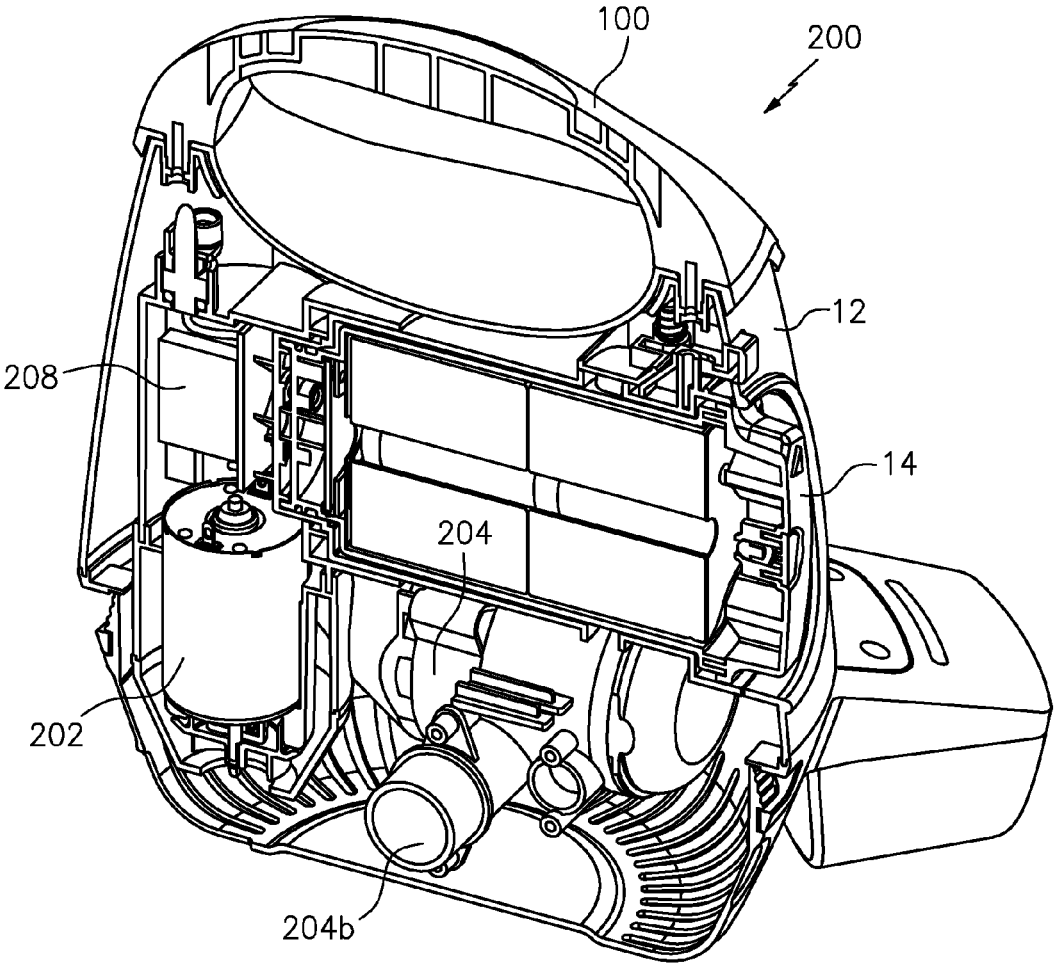

FIGS. 9*a*, 9*b*: Series Centrifugal Pump Configuration

FIGS. 9*a*, 9*b* shows a utility pump generally indicated as 200 that forms the basis for the instant continuation-in-part application of patent application Ser. No. 13/222,303, filed 31 Aug. 2011, consistent with that set forth below. Similar elements in FIGS. 1-8 and FIG. 9 are provided with similar reference numerals for the sake of consistency. So as to not unduly clutter FIG. 9, not every element in FIG. 9 is provided a reference numeral consistent with FIG. 108.

The utility pump comprises a series configuration of two centrifugal pumps 202, 204 that gives an increase in the head pressure and is integral package within the pump housing 12.

The utility pump or pump system 200 comprises of an internal "hydraulics" assembly which includes the two centrifugal pumps 202, 204. The suction side of the first centrifugal pump 202 receives water through a lower strainer unit or openings 72. The discharge of the first pump 202 is directly integrated into the suction side of the second centrifugal pump 204. The fluid is then discharged out the second pump through a fitting 204*b* for providing out a discharge 206 (FIG. 9*a*). This hydraulic unit along with the rechargeable battery pack 14 and printed circuit board (PCB) controls are housed inside a thermoplastic assembly or pump housing 12.

In FIG. 9, the utility pump 200 is designed to meet consumer pumping needs for applications which AC or other DC power may not be readily available or convenient for use.

In FIG. 9*a*, the utility pump 200 includes a battery assembly release button 210 that may be pressed in order to allow the battery 14 to be rotated and removed from the housing 12. See the switch or button 50 shown in FIGS. 1-3.

The utility pump 200 also includes pump legs 212*a*, 212*b*, 212*c*, and 212*d* for supporting and stabilizing the utility pump 200.

The Scope of the Invention

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein. Also, the drawings herein are not necessarily drawn to scale.

Although the invention has been described and illustrated with respect to exemplary embodiments thereof, the foregoing and various other additions and omissions may be made therein and thereto without departing from the spirit and scope of the present invention.

What we claim is:

1. A utility pump comprising: a housing having a series configuration of integral pumps, also having a battery receiving portion configured with a flat wall having electrical terminals arranged thereon for receiving power for providing to the utility pump; and a battery having a protruding portion configured with a corresponding flat wall having corresponding electrical terminals arranged thereon, the corresponding electrical terminals being configured to contact respectively both of the electrical terminals on the flat wall of the battery receiving portion to provide power from the battery to the utility pump when the protruding portion of the battery is inserted into the battery receiving portion of the housing and rotated to an "ON" position, and the corresponding electrical terminals also being configured not to contact respectively both of the electrical terminals on the flat wall of the battery receiving portion when the battery is rotated from the "ON" position to an "OFF" position; wherein the battery receiving portion has an internal wall configured with at least one axial channel therein; and the protruding portion has an external wall having at least one further protruding portion configured to engage the at least one axial channel for guiding and orienting the battery when inserted into the battery receiving portion into a first rotational position; wherein the internal wall of the battery receiving portion is configured with at least one partial circumferential channel; and the at least one further protruding portion is configured to engage the at least one partial circumferential channel for rotating the battery from a first position when the protruding portion of the battery is inserted into the battery receiving portion of the housing into either a second rotational position, including the "ON" position where the utility pump is turned "ON", or to a third rotational position, including the "OFF" position where the utility pump is turned "OFF."

2. The utility pump according to claim 1, wherein the protruding portion has a cylindrical wall with an 0-ring configured to frictionally engage and make sealing contact with an internal wall of the battery receiving portion to prevent fluid from contacting the electrical terminals and the corresponding electrical terminals when the battery is inserted into the battery receiving portion, so that the series configuration of integral pumps may be operated when either partially or totally submersed in the fluid.

3. The utility pump according to claim 1, wherein the at least one axial channel comprises two axial channels disposed on opposite sides of the battery receiving portion, and the at least one partial circumferential channel comprises two partial circumferential channels; and the external wall of the protruding portion includes two protruding portions configured to engage respectively the two axial channels for guiding and orienting the battery when inserted into the battery receiving portion, and to engage the two partial circumferential channels for positioning the battery in either the second rotational position or the third rotational position.

4. The utility pump according to claim 3, wherein the two axial channels are configured and dimensioned with different sizes, and the two protruding portions configured and dimensioned with corresponding different sizes, so that the battery can only be inserted into the battery receiving portion with one orientation.

5. A utility pump comprising: a housing having a series configuration of integral pumps, also having a battery receiving portion configured with a flat wall having electrical terminals arranged thereon for receiving power for providing to the utility pump; and a battery having a protruding portion configured with a corresponding flat wall having corresponding electrical terminals arranged thereon, the corresponding electrical terminals being configured to contact respectively both of the electrical terminals on the flat wall of the battery receiving portion to provide power from the battery to the utility pump when the protruding portion of the battery is inserted into the battery receiving portion of the housing and rotated in one direction to an "ON" position, and the corresponding electrical terminals also being configured not to contact respectively both of the electrical terminals on the flat wall of the battery receiving portion when the battery is rotated from the "ON" position to an "OFF" position; the battery receiving portion has an internal wall configured with at least one axial channel therein, the internal wall of the battery receiving portion configured with at least one partial circumferential channel; the protruding portion has an external wall having at least one further protruding portion configured to engage the at least one axial channel for guiding and orienting the battery when inserted into the battery receiving portion into a first rotational position; the at least one partial circumferential channel has a flexible locking device having a first face and a second face that is configured on a flexible hinge portion; the first face is configured on an angle so as to respond to the at least one protruding portion and flex the flexible locking device downwardly into an opening or slot and below a surface of the axial channel so as to allow the at least one further protruding portion to slide or pass by when the battery is rotated in the one direction in the battery receiving portion; the flexible locking device is configured to flex back upwardly above the channel surface once the at least one further protruding portion slides or passes by the first face; and the second face is configured to extend into the partial circumferential channel above the channel surface so as to prevent the at least one protruding portion of the external wall of the battery from passing or sliding by when the battery is rotated in an opposite direction in the battery receiving portion so as to lock the battery in the battery receiving portion so it cannot be removed.

6. The utility pump according to claim 5, wherein the housing has a switch configured to respond to a switching actuation and move the flexible locking device downwardly into the opening or slot and below the channel surface to allow the at least one further protruding portion to pass by when the battery is rotated in the opposite direction in the battery receiving portion, so that the battery may be moved to the first rotational position and removed from the battery receiving portion.

7. The utility pump according to claim 1, wherein the housing has a detachable two-part construction, including a lower part configured with openings to receive fluid being pumped, and an upper part configured with an outlet port for providing the fluid being pumped.

8. The utility pump according to claim 1, wherein the battery is rechargeable.

9. The utility pump according to claim 1, wherein the battery has a cover portion having an arrow-shaped member configured to provide a visual indication of the orientation of the battery.

10. The utility pump according to claim 1, wherein the series configuration of the integral pumps comprises a first centrifugal pump and a second centrifugal pump.

11. The utility pump according to claim 10, wherein a suction side of the first centrifugal pump is configured to receive a fluid through a lower strainer unit; and a discharge of the first centrifugal pump is configured to be directly integrated into a corresponding suction side of the second centrifugal pump so that the fluid is then discharged out the second centrifugal pump through a fitting.

12. The utility pump according to claim 11, wherein the utility pump comprises a rechargeable battery pack and printed circuit board (PCB) controls that are housed inside a thermoplastic assembly.

13. A utility pump comprising: a housing configured with a series configuration of integral pumps, and also configured with a battery receiving portion having electrical terminals for receiving power for providing to the series configuration of the integral pumps, the battery receiving portion having an internal wall configured with at least one axial channel therein, the internal wall of the battery receiving portion configured with at least one partial circumferential channel; and a battery having a protruding portion with corresponding electrical terminals configured to contact the electrical terminals on the battery receiving portion to provide the power to the series configuration of integral pumps when the protruding portion of the battery is inserted into the battery receiving portion of the housing and rotated in one direction to an "ON" position, and also configured so as not to contact the electrical terminals of the battery receiving portion when the battery is not rotated to the "ON" position, the protruding portion having an external wall with at least one further protruding portion configured to engage the at least one axial channel for guiding and orienting the battery when inserted into the battery receiving portion into a first rotational position, the at least one further protruding portion configured to engage the partial circumferential channel for rotating the battery from a first position when the protruding portion of the battery is inserted into the battery receiving portion of the housing into either a second rotational position, including the "ON" position where the series configuration of integral pumps is turned "ON", or to a third rotational position, including the "OFF" position where the series configuration of integral pumps is turned "OFF; the at least one partial circumferential channel having a flexible locking device with a first face and a second face that is configured on a flexible hinge portion; the first face being configured on an angle so as to respond to the at least one further protruding portion and flex the flexible locking device downwardly into an opening or slot and below a surface of the axial channel so as to allow the at least one further protruding portion to slide or pass by when the battery is rotated in the one direction in the battery receiving portion; the flexible locking device being configured to flex back upwardly above the channel surface once the at least one further protruding portion slides or passes by the first face; and the second face being configured to extend into the partial circumferential channel above the channel surface so as to prevent the at least one further protruding portion from passing or sliding by when the battery is rotated in an opposite direction in the battery receiving portion so as to lock the battery in the battery receiving portion so it cannot be removed.

14. The utility pump according to claim 13, wherein the housing has a switch configured to respond to a switching actuation and move the flexible locking device downwardly into the opening or slot and below the channel surface to allow the at least one further protruding portion to pass by when the battery is rotated in the opposite direction in the battery receiving portion, so that the battery may be moved to the first rotational position and removed from the battery receiving portion.

* * * * *